US005083348A

United States Patent [19]

Gorza et al.

[11] Patent Number: 5,083,348

[45] Date of Patent: Jan. 28, 1992

[54] CLOSURE DEVICE, PARTICULARLY FOR SKI BOOTS

[75] Inventors: Roberto Gorza, Feltre; Mirco Battistella, Breda di Piave, both of Italy

[73] Assignee: Nordica S.p.A., Montebelluna, Italy

[21] Appl. No.: 555,693

[22] Filed: Jul. 23, 1990

[30] Foreign Application Priority Data

Jul. 31, 1989 [IT] Italy ..... 82571 A/89

[51] Int. Cl.[5] ..... A43C 11/00

[52] U.S. Cl. ..... 24/68 SK; 24/71 SK; 36/50

[58] Field of Search ..... 24/69 SK, 68 SK, 69 TS, 24/71 SK; 36/117, 115, 50

[56] References Cited

U.S. PATENT DOCUMENTS 4,691,454 9/1987 Ottieri ..... 24/68 SK X
4,765,069 8/1988 Baggio et al. ..... 24/68 SK X
4,852,222 8/1989 Courvoisier et al. ..... 24/71 SK

*Primary Examiner*—Laurie K. Cranmer
*Attorney, Agent, or Firm*—Guido Modiano; Albert Josif

[57] ABSTRACT

A closure device, particularly usable in ski boots composed of a shell with which a front quarter and a rear quarter are associated, includes a lever which is pivoted, at one end, to the rear quarter or to a slider which is slidable at an adapted guide to which an adjustable-length rod is pivoted in an intermediate region. The rod interacts, at its free end, with a locking element which is located at the rear quarter or on the slider. A first traction element rigidly associated with the shell and at least one second traction element, which is coupled, at its ends, to a member in relative motion with respect to the pivoting axis of said lever and/or to a member which is fixed with respect to the pivoting axis, are furthermore associated with the slider. The device furthermore includes elements adapted to limit the opening angle between the lever and the rod as well as a resilient member adapted to keep the free end of the rod in contact with the locking element.

14 Claims, 1 Drawing Sheet

CLOSURE DEVICE, PARTICULARLY FOR SKI BOOTS

BACKGROUND OF THE INVENTION

The present invention relates to a closure device particularly for rear-entry ski boots.

Numerous kinds of levers suitable to allow for example the closure of one or two quarters of a ski boot by means of a cable or a strap are currently known.

In the specific case of rear-entry ski boots, it is observed, in known levers, that the temporary or fixed coupling point between a cable and the lever is in any case located at a given distance with respect to the pivoting axis of said lever: this arrangement in fact allows to release a given length of cable which is necessary to allow the optimum opening of the quarters.

Known devices therefore use, for this purpose, levers which have such dimensions as to affect most of the rear quarter; these devices are cumbersome and require very long cables that must be taken up entirely in order to close the quarters.

Furthermore, the length of the cables is such that when the quarters are moved close together, prior to the actuation of the lever said cables are slack, resulting in a very poor aesthetic appearance of the boot.

U.S. Pat. No. 4,691,454 and U.S. Pat. No. 4,711,042, for example, disclose closure systems of the above type.

Another disadvantage observed in known devices for the closure of boot quarters is constituted by the fact that if the skier removes the skis and is forced to walk, as in the case in which he must queue to gain access to a ski-lift in which the skis are stored separately or held in one's hands, the opening of the levers entails the total opening of the quarters, and consequently the foot can accidentally slip off the boot.

Devices are finally known which comprise means adapted to keep the rear quarter locked with respect to the shell or to release the two with respect to one another so as to allow the opening of the rear quarter.

U.S. Pat. No. 4,499,676 discloses a front-entry ski boot provided with a rocker pivoted to the rear quarter and adapted to release the rear quarter for walking.

These devices, however, do not allow to select the degree of opening of the quarter or upper quarter and therefore do not allow the skier to walk optimally.

SUMMARY OF THE INVENTION

The aim of the present invention is therefore to eliminate the disadvantages described above in known types by providing a device which allows to achieve the optimum and rapid closure for example of the quarters of a ski boot and has at the same time small dimensions.

Within the scope of the above described aim, an important object is to provide a device which allows to select the degree of opening of the quarters so as to allow the skier to walk optimally, preventing the foot from accidentally slipping off the boot.

Another important object is to provide a device in which the skier simply has to act on the lever to complete the closure since the traction elements are already partially taken up.

Not least object is to provide a device which associates with the preceding characteristics that of being safe and reliable in use.

This aim, these objects and others which will become apparent hereinafter are achieved by a closure device particularly for ski boots having a front quarter and a rear quarter associated with a shell, characterized in that it comprises a toggle lever having a first end pivoted to a fixed point of said rear quarter and a second end pivoted to a slider, said toggle lever comprising a rod pivoted to a lever, said slider being slideable at said rear quarter, a first traction element connecting said slider to said shell, at least one second traction element having a first end connected to said front quarter and a second end connected to said rear quarter, at least a portion of said second traction element being guided at said slider, said rod being adjustable in length and having a free end adapted to engage a locking element for adjusting the closure of said quarters.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
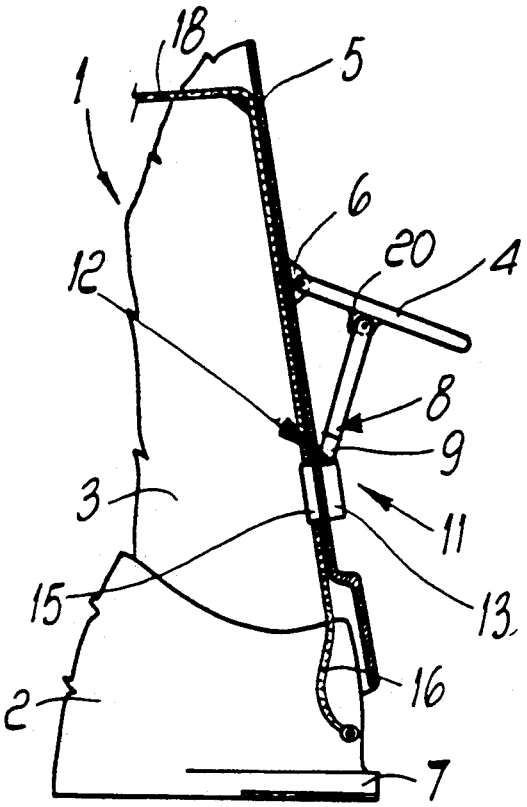
FIG. 1 is a partial sectional side view of the rear portion of a ski boot according to the invention.

With reference to the above figures, the reference numeral 1 indicates a ski boot constituted by a shell 2 with which at least one rear quarter 3 is associated.

The closure device comprises a lever 4 pivoted to the rear lateral surface 5 of the rear quarter 3 at an adapted pair of brackets 6.

A rod 8 is pivoted to the lever 4 approximately at a median region and toward the underlying heel 7.

Figure 2:
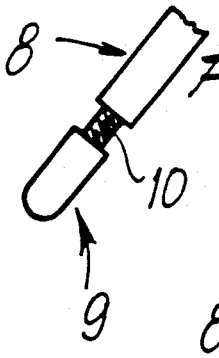
FIG. 2 is a detail view of the end of the rod.

Said rod is adjustable in length (as shown in FIG. 2), its free end 9 having a threaded stem 10 which can be screwed at an adapted threaded seat defined on the remaining part of said rod.

Said free end 9 temporarily interacts with an adpated locking element 11 which is constituted by a complementarily shaped seat 12 defined at a slider 13.

Said slider slides within a guide 14 provided longitudinally at the rear lateral surface 5 of the rear quarter 3.

The slider 13 thus advantageously has a first portion which is external to the rear quarter 3 and has the seat 12 for the end 9 of the rod 8, and a second portion which is internal to the rear quarter 3 and in indicated by 15.

A first traction element is rigidly associated at said portion 15 and is constituted by a first cable 16 which is rigidly associated with the shell 2 at its other end.

A second cable 17 and a third cable 18 are guided on the opposite side with respect to the first cable 16 at the inner portion 15 of the slider 13 and are rigidly associated, at one end, with a member which is in relative motion with respect to the pivoting axis of the lever 4, such as for example the front quarter, and, at the other end, with a fixed member, again with respect to the pivoting axis of the lever 4, such as for example the rear surface of the rear quarter 3.

Figure 4:
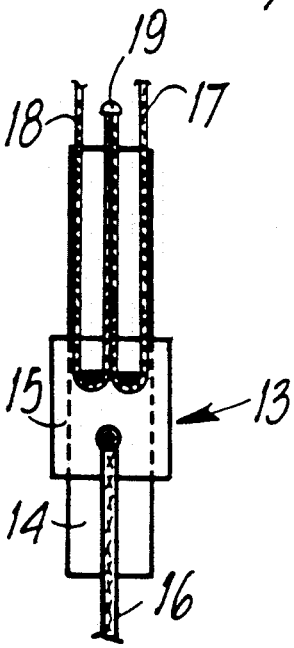
FIG. 4 is a front view of the slider.

In this case, as illustrated in FIG. 4, the ends of the second and third cables are fastened to the rear quarter by means of an adapted rivet 19.

The device furthermore comprises means adapted to limit the opening angle between the lever 4 and the bar 8, said means being constituted by a wing 20 which protrudes perpendicularly to the lever 4 in a region adjacent to the pivoting axis of the rod 8 in the portion adjacent to the brackets 6.

The device furthermore comprises a resilient member adapted to keep the free end 9 of the rod 8 in contact with the locking element 11.

Figure 3:
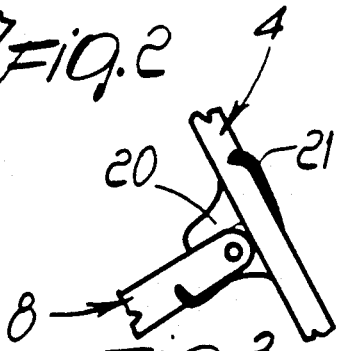
FIG. 3 is a partial side view of the means adapted to limit the opening angle between the lever and the rod.

Said resilient member advantageously comprises a spring 21 which by embracing the lever 4 and the rod 8 forces said rod to abut at the wing 20, as shown in FIG. 3.

A further resilient member adapted to force the lever 4, and therefore the rod 8, at the seat 12, provided on the locking element 11, may advantageously be provided also at the axis of pivoting of the lever 4 to the brackets 6.

The operation of the device is as follows: when the quarters are opened, the second and third cables impart an upward movement to the slider 13 until the rod 8, in the rotation imparted thereto, abuts against the wing 20 which protrudes from the lever 4.

In this position the quarters are half-open and therefore allow the skier to walk.

Subsequently, by lifting the lever 4, the free end 9 of the rod 8 can be made to disengage from the seat 12 provided on the locking element 11, thus allowing the slider 13 to rise further, allowing the release of the second and third cables until the quarters open completely.

Vice versa, if the quarters are closed, when the rear quarter is moved toward the calf by the skier, the first cable 16, which is fixed to the shell 2, causes the slider 13 to slide downward until it engages, at the seat 12, the free end 9 of the rod 8.

The skier must subsequently merely push the lever 4 to achieve the complete closure of the quarters, the first cable 16 being passive in this step.

The degree of closure of the quarters can be changed by appropriately unscrewing or screwing the free end 9 of the rod 8.

The device therefore allows to close the quarters by having the skier operate on the lever only for the final tensioning of the second and third cables.

The device furthermore allows to partially limit the opening angle of the rear quarter so as to allow the skier to walk easily.

It has thus been observed that the invention has achieved the intended aim and objects, a device having been obtained which allows to achieve an optimum and rapid closure due to the particular arrangement of the second and third cables which can take up twice the length of the working portion of said cables, with respect to the translatory motion of the slider 13 within the guide 14.

This allows to further reduce the dimensions of the device, refining the overall aesthetic characteristics of the boot.

The particular configuration of the lever and of the rod furthermore allows to select the opening degree of the rear quarter, which can be in any case adjusted so as to further improve the walking condition for the skier.

The device according to the invention is naturally susceptible to numerous modifications and variations, all of which are within the scope of the same inventive concept.

Figure 5:
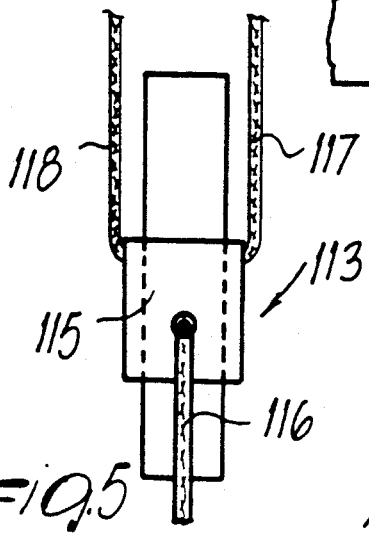
FIG. 5 is a view, similar to FIG. 4, of the slider according to a further aspect of the invention.

Thus, for example, FIG. 5 illustrates a slider 113 in which the first cable 116 is again rigidly associated therewith and with the shell 102, and a second cable 117 and a third cable 118 are associated with the slider 113 and rigidly associated for example with the front quarter at their ends.

The cables 117 and 118 may naturally be replaced with a single cable.

Figure 6:
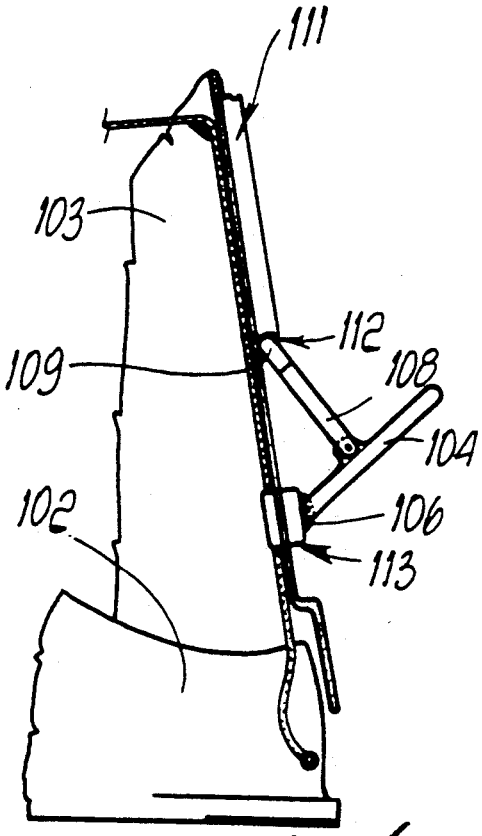
FIG. 6 is a view, similar to FIG. 1, of a ski boot according to a further aspect of the invention.

As illustrated in FIG. 6, the lever 104 which is interposed between the adapted shoulders 106 can be pivoted to said slider 113 at the portion which is external to the rear quarter 103.

The lever 104 is thus inverted with respect to the embodiment illustrated in FIG. 1, and the rod 108 is directed toward the upper end of the rear quarter 103.

A locking element 111, such as a ridge having a seat 112 toward the slider 113, which is shaped complementarily to the free end 109 of the rod 108, furthermore protrudes externally from said rear quarter.

Figure 7:
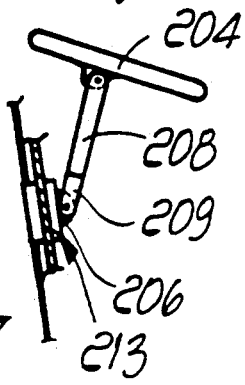
FIG. 7 is a detail side view of the lever of FIG. 6.

FIG. 7 illustrates a further embodiment in which the rod 208 pivoted to the lever 204 has its terminal end 209 pivoted at a pair of brackets 206 rigidly associated with the slider 213.

The lever 204 in this case interacts with the locking element on the rear quarter.

The dimensions and the materials which constitute the individual components of the device may naturally be the most suitable according to the specific requirements.

We claim:

1. Closure device, particularly for ski boots having a front quarter and a rear quarter associated with a shell, comprising a toggle lever having a first end pivoted to a fixed point of said rear quarter and a second end pivoted to a slider, said toggle lever comprising a rod pivoted to a lever, said slider being slideable at said rear quarter, a first traction element connecting said slider to said shell, at least one second traction element having a first end connected to said front quarter and a second end connected to said rear quarter, at least a portion of said second traction element being guided at said slider, said rod being adjustable in length and having a free end adapted to engage a locking element for adjusting the closure of said quarters.

2. Device according to claim 1, comprising a means adapted to limit an opening angle between said lever and said rod and a resilient member adapted to keep the free end of said rod in contact with said locking element.

3. Device according to claim 2, wherein said lever has an end pivoted to a rear surface of said rear quarter or to said slider at an adapted pair of brackets which protrude therefrom, and wherein said means adapted to limit the opening angle between said lever and said rod are constituted by a wing which protrudes perpendicularly to said lever in a region adjacent to a pivoting axis of said rod in the portion adjacent to said brackets.

4. Device according to claim 2, wherein said lever has an end pivoted to a rear surface of said rear quarter or to said slider at an adapted pair of brackets which protrude therefrom, and wherein said means adapted to limit the opening angle between said lever and said rod are constituted by a wing which protrudes perpendicularly to said lever in a region adjacent to a pivoting axis of said rod in the portion adjacent to said brackets, and further wherein said resilient member adapted to keep the free end of said rod in contact with said locking element comprises a spring which embraces said lever and said rod to bias the latter at said wing.

5. Device according to claim 2, wherein said lever has an end pivoted to a rear surface of said rear quarter or to said slider at an adapted pair of brackets which protrude therefrom, and wherein said resilient member is arranged at a pivoting axis of said lever to said brackets.

6. Device according to claim 1, wherein said lever has an end pivoted to a rear surface of said rear quarter or of said slider at an adapted pair of brackets which protrude therefrom.

7. Device according to claim 1, wherein said rod is pivoted to said lever approximately at a median region thereof and toward an underlying heel of said boot, said free end being provided with a threaded axial stem which can be screwed at an adapted and complementarily threaded seat provided on said rod.

8. Device according to claim 1, wherein said free end of said rod temporarily interacts with an adapted and complementarily shaped seat provided on said locking element.

9. Device according to claim 1, wherein said locking element is constituted by said slider and wherein a seat is provided at a surface of said slider which is directed toward a pivot point of said lever to said rear quarter.

10. Device according to claim 1, wherein said locking element is constituted by a ridge which protrudes from a rear lateral surface of said rear quarter, a seat being provided on a surface of said ridge which is directed toward said slider.

11. Device according to claim 1, wherein said slider slides within an adapted guide provided longitudinally to said rear quarter, said slider having a portion external to said rear quarter on which a seat for the free end of said rod is provided or to which said lever is pivoted or to which said free end of said rod is pivoted, said slider further having a second portion with which one end of a first traction element is rigidly associated, another end of said traction element being associated with said shell.

12. Device according to claim 11, wherein a second traction element and a third traction element have one end rigidly associated with said front quarter and another end rigidly associated with the rear surface of said rear quarter, and are guided to said slider on an opposite side with respect to said first traction element.

13. Device according to claim 11, wherein a single second traction element or a second and a third separate traction elements are laterally coupled to said second portion of said slider on an opposite site with respect to said first traction element and are coupled, at their ends, to said front quarter.

14. Device according to claim 1, wherein said rod has an end pivoted to a rear surface of said rear quarter or to said slider at an adapted pair of brackets which protrode therefrom, said lever having at least one end interacting with said locking element.

* * * * *